US009431733B1

(12) United States Patent
Heistand et al.

(10) Patent No.: US 9,431,733 B1
(45) Date of Patent: Aug. 30, 2016

(54) DOUBLE ACTION COMPLIANT CONNECTOR PIN

(71) Applicant: Dell Products, LP, Round Rock, TX (US)

(72) Inventors: Raymond D. Heistand, Round Rock, TX (US); Sandor Farkas, Round Rock, TX (US); Bhyrav M. Mutnury, Round Rock, TX (US)

(73) Assignee: DELL PRODUCTS, LP, Round Rock ( * ) Notice: Subject to any disclaimer, the term of this patent is extended or adjusted under 35 U.S.C. 154(b) by 0 days.

(21) Appl. No.: 14/619,735

(22) Filed: Feb. 11, 2015

(51) Int. Cl.
*H01R 12/58* (2011.01)
*H01R 43/16* (2006.01)

(52) U.S. Cl.
CPC ..... *H01R 12/585* (2013.01); *H01R 43/16* (2013.01)

(58) Field of Classification Search
CPC ..... H01R 12/585
USPC ..... 439/751, 82, 75
See application file for complete search history.

(56) References Cited

U.S. PATENT DOCUMENTS 3,333,225 A * 7/1967 McNutt ..... H01R 29/00 439/692
3,634,819 A * 1/1972 Evans ..... H05K 3/308 439/751
4,260,212 A * 4/1981 Ritchie ..... H01R 4/2425 29/885
4,446,505 A * 5/1984 Long ..... H01R 12/585 361/784
4,923,414 A * 5/1990 Sitzler ..... H01R 12/585 439/751
5,106,310 A * 4/1992 Krajewski ..... H05K 3/368 439/75
5,564,954 A * 10/1996 Wurster ..... H01R 12/585 439/751
5,761,050 A * 6/1998 Archer ..... H01R 12/585 361/744
6,305,949 B1 * 10/2001 Okuyama ..... H01R 12/585 439/75
6,309,259 B1 * 10/2001 Yamashita ..... H01R 12/585 439/439
6,428,329 B2 * 8/2002 Orui ..... H01R 43/205 439/65
6,565,392 B2 * 5/2003 Padro ..... H01R 13/428 439/751
6,592,382 B2 * 7/2003 Wurster ..... H05K 3/366 439/82
6,623,280 B2 * 9/2003 Oldenburg ..... H01R 12/52 439/590
7,044,807 B2 * 5/2006 Furuno ..... H01R 12/585 439/751
7,083,431 B1 * 8/2006 Darr ..... H01R 12/585 439/75
7,101,197 B2 * 9/2006 Naito ..... H05K 1/144 439/75

(Continued)

FOREIGN PATENT DOCUMENTS

DE EP 0 084 318 A2 7/1983

*Primary Examiner* — Ross Gushi
(74) *Attorney, Agent, or Firm* — Larson Newman, LLP

(57) ABSTRACT

An electrical connector pin includes a first contact portion that includes a first arched flexure element, a second arched flexure element disposed in lateral opposition to the first arched flexure element, and a second contact portion. The second contact portion includes a third arched flexure element and a fourth arched flexure element disposed in lateral opposition to the third arched flexure element, the second contact portion disposed in tandem with the first contact portion.

20 Claims, 8 Drawing Sheets

(56) References Cited

U.S. PATENT DOCUMENTS 7,247,031 B2 * 7/2007 Naito ..... H01R 9/2458 439/75
7,249,981 B2 * 7/2007 Chen ..... H01R 12/585 439/751
7,306,493 B2 * 12/2007 Seo ..... H01R 12/585 439/751
7,377,823 B2 5/2008 Chen
7,445,499 B2 * 11/2008 Nunokawa ..... H01R 12/585 439/567
7,527,533 B2 * 5/2009 Lappoehn ..... H01R 12/585 439/751
7,780,483 B1 * 8/2010 Ravlich ..... H01R 12/585 439/751
7,963,796 B2 * 6/2011 Sypolt ..... H01R 12/58 439/511
8,002,559 B2 * 8/2011 Thiel ..... H01R 12/585 439/751
8,317,525 B2 * 11/2012 Bayerer ..... H01R 12/585 439/75
8,545,237 B2 * 10/2013 Johnson ..... H01R 12/523 439/75
8,556,641 B2 * 10/2013 Wilinski ..... H01R 31/085 439/75
8,579,638 B2 * 11/2013 Schaarschmidt .... H01R 12/585 439/82
9,106,009 B2 * 8/2015 Zhao ..... H01R 12/585
9,214,760 B2 * 12/2015 Endo ..... H01R 13/58
2001/0031567 A1 * 10/2001 Orui ..... H01R 43/205 439/74
2003/0124886 A1 * 7/2003 Reisdorf ..... H01R 13/05 439/82
2004/0242033 A1 * 12/2004 Hu ..... H01R 12/585 439/82
2008/0050947 A1 * 2/2008 Nunokawa ..... H01R 12/585 439/82
2009/0023310 A1 * 1/2009 Thiel ..... H01R 12/585 439/66
2012/0003847 A1 * 1/2012 Johnson ..... H01R 12/523 439/65
2012/0156898 A1 * 6/2012 Kallee ..... H01R 12/585 439/65
2014/0213080 A1 * 7/2014 Miyake ..... H01R 12/585 439/82
2014/0302723 A1 * 10/2014 Zhao ..... H01R 12/585 439/751
2014/0342619 A1 * 11/2014 Uchida ..... H01R 12/585 439/751
2015/0118871 A1 * 4/2015 Yagi ..... H01R 12/523 439/65

* cited by examiner

DOUBLE ACTION COMPLIANT CONNECTOR PIN

FIELD OF THE DISCLOSURE

The present disclosure generally relates to information handling systems, and more particularly relates to electrical connectors.

BACKGROUND

As the value and use of information continues to increase, individuals and businesses seek additional ways to process and store information. One option is an information handling system. An information handling system generally processes, compiles, stores, or communicates information or data for business, personal, or other purposes. Technology and information handling needs and requirements can vary between different applications. Thus information handling systems can also vary regarding what information is handled, how the information is handled, how much information is processed, stored, or communicated, and how quickly and efficiently the information can be processed, stored, or communicated. The variations in information handling systems allow information handling systems to be general or configured for a specific user or specific use such as financial transaction processing, airline reservations, enterprise data storage, or global communications. In addition, information handling systems can include a variety of hardware and software resources that can be configured to process, store, and communicate information and can include one or more computer systems, graphics interface systems, data storage systems, networking systems, and mobile communication systems. Information handling systems can also implement various virtualized architectures. Data and voice communications among information handling systems may be via networks that are wired, wireless, or some combination.

BRIEF DESCRIPTION OF THE DRAWINGS

It will be appreciated that for simplicity and clarity of illustration, elements illustrated in the Figures are not necessarily drawn to scale. For example, the dimensions of some elements may be exaggerated relative to other elements. Embodiments incorporating teachings of the present disclosure are shown and described with respect to the drawings herein, in which.

The use of the same reference symbols in different drawings indicates similar or identical items.

DETAILED DESCRIPTION OF THE DRAWINGS

The following description in combination with the Figures is provided to assist in understanding the teachings disclosed herein. The description is focused on specific implementations and embodiments of the teachings, and is provided to assist in describing the teachings. This focus should not be interpreted as a limitation on the scope or applicability of the teachings.

Figure 1:
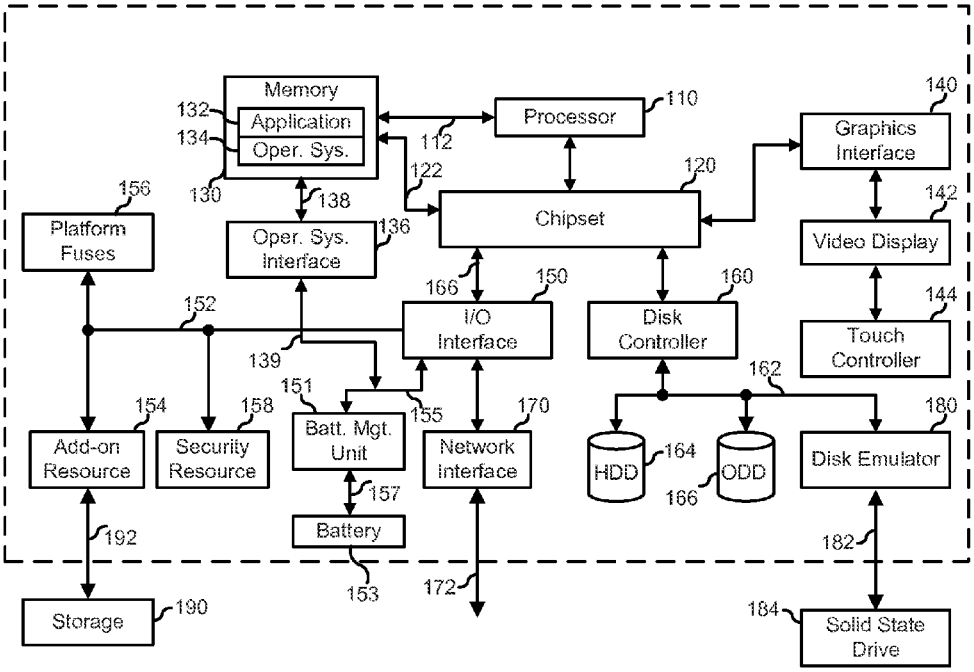
FIG. 1 is a block diagram illustrating an information handling system according to an embodiment of the present disclosure.

FIG. 1 illustrates a generalized embodiment of information handling system 100. For purpose of this disclosure information handling system 100 can include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, information handling system 100 can be a personal computer, a laptop computer, a smart phone, a tablet device or other consumer electronic device, a network server, a network storage device, a switch router or other network communication device, or any other suitable device and may vary in size, shape, performance, functionality, and price. Further, information handling system 100 can include processing resources for executing machine-executable code, such as a central processing unit (CPU), a programmable logic array (PLA), an embedded device such as a System-on-a-Chip (SoC), or other control logic hardware. Information handling system 100 can also include one or more computer-readable medium for storing machine-executable code, such as software or data. Additional components of information handling system 100 can include one or more storage devices that can store machine-executable code, one or more communications ports for communicating with external devices, and various input and output (I/O) devices, such as a keyboard, a mouse, and a video display. Information handling system 100 can also include one or more buses operable to transmit information between the various hardware components.

Information handling system 100 can include devices or modules that embody one or more of the devices or modules described above, and operates to perform one or more of the methods described above. Information handling system 100 includes a processor 110, a chipset 120, a memory 130, a graphics interface 140, a disk controller 160, a disk emulator 180, an input/output (I/O) interface 150, and a network interface 170. Processor 110 is connected to chipset 120 via processor interface 112. Processor 110 is connected to memory 130 via memory bus 118. Memory 130 is connected to chipset 120 via a memory bus 122. Graphics interface 140 is connected to chipset 110 via a graphics interface 114, and provides a video display output 146 to a video display 142. Video display 142 is connected to touch controller 144 via touch controller interface 148. In a particular embodiment, information handling system 100 includes separate memories that are dedicated to processor 110 via separate memory interfaces. An example of memory 130 includes random access memory (RAM) such as static RAM (SRAM), dynamic RAM (DRAM), non-volatile RAM (NV-RAM), or the like, read only memory (ROM), another type of memory, or a combination thereof. Memory 130 can store, for example, at least one application 132 and operating system 134. Operating system 134 includes operating system code operable to detect resources within information handling system 100, to provide drivers for the resources, initialize the resources, to access the resources, and to support execution of the at least one application 132. Operating system 134 has access to system elements via an operating system interface 136. Operating system interface 136 is connected to memory 130 via connection 138.

Battery management unit (BMU) 151 is connected to I/O interface 150 via battery management unit interface 155. BMU 151 is connected to battery 153 via connection 157. Operating system interface 136 has access to BMU 151 via connection 139, which is connected from operating system interface 136 to battery management unit interface 155.

Graphics interface 140, disk controller 160, and I/O interface 150 are connected to chipset 120 via interfaces that may be implemented, for example, using a Peripheral Component Interconnect (PCI) interface, a PCI-Extended (PCI-X) interface, a high-speed PCI-Express (PCIe) interface, another industry standard or proprietary communication interface, or a combination thereof. Chipset 120 can also include one or more other I/O interfaces, including an Industry Standard Architecture (ISA) interface, a Small Computer Serial Interface (SCSI) interface, an Inter-Integrated Circuit ($I^2C$) interface, a System Packet Interface (SPI), a Universal Serial Bus (USB), another interface, or a combination thereof.

Disk controller 160 is connected to chipset 120 via connection 116. Disk controller 160 includes a disk interface 162 that connects the disc controller to a hard disk drive (HDD) 164, to an optical disk drive (ODD) 166, and to disk emulator 180. An example of disk interface 162 includes an Integrated Drive Electronics (IDE) interface, an Advanced Technology Attachment (ATA) such as a parallel ATA (PATA) interface or a serial ATA (SATA) interface, a SCSI interface, a USB interface, a proprietary interface, or a combination thereof. Disk emulator 180 permits a solid-state drive 184 to be connected to information handling system 100 via an external interface 182. An example of external interface 182 includes a USB interface, an IEEE 1194 (Firewire) interface, a proprietary interface, or a combination thereof. Alternatively, solid-state drive 184 can be disposed within information handling system 100.

I/O interface 150 is connected to chipset 120 via connection 166. I/O interface 150 includes a peripheral interface 152 that connects the I/O interface to an add-on resource 154, to platform fuses 156, and to a security resource 158. Peripheral interface 152 can be the same type of interface as connects graphics interface 140, disk controller 160, and I/O interface 150 to chipset 120, or can be a different type of interface. As such, I/O interface 150 extends the capacity of such an interface when peripheral interface 152 and the I/O channel are of the same type, and the I/O interface translates information from a format suitable to such an interface to a format suitable to the peripheral channel 152 when they are of a different type. Add-on resource 154 can include a data storage system, an additional graphics interface, a network interface card (NIC), a sound/video processing card, another add-on resource, or a combination thereof. As an example, add-on resource 154 is connected to data storage system 190 via data storage system interface 192. Add-on resource 154 can be on a main circuit board, on separate circuit board or add-in card disposed within information handling system 100, a device that is external to the information handling system, or a combination thereof.

Network interface 170 represents a NIC disposed within information handling system 100, on a main circuit board of the information handling system, integrated onto another component such as chipset 120, in another suitable location, or a combination thereof. Network interface 170 is connected to I/O interface 150 via connection 174. Network interface device 170 includes network channel 172 that provides an interface to devices that are external to information handling system 100. In a particular embodiment, network channel 172 is of a different type than peripheral channel 152 and network interface 170 translates information from a format suitable to the peripheral channel to a format suitable to external devices. An example of network channels 172 includes InfiniBand channels, Fibre Channel channels, Gigabit Ethernet channels, proprietary channel architectures, or a combination thereof. Network channel 172 can be connected to external network resources (not illustrated). The network resource can include another information handling system, a data storage system, another network, a grid management system, another suitable resource, or a combination thereof.

Figure 2:
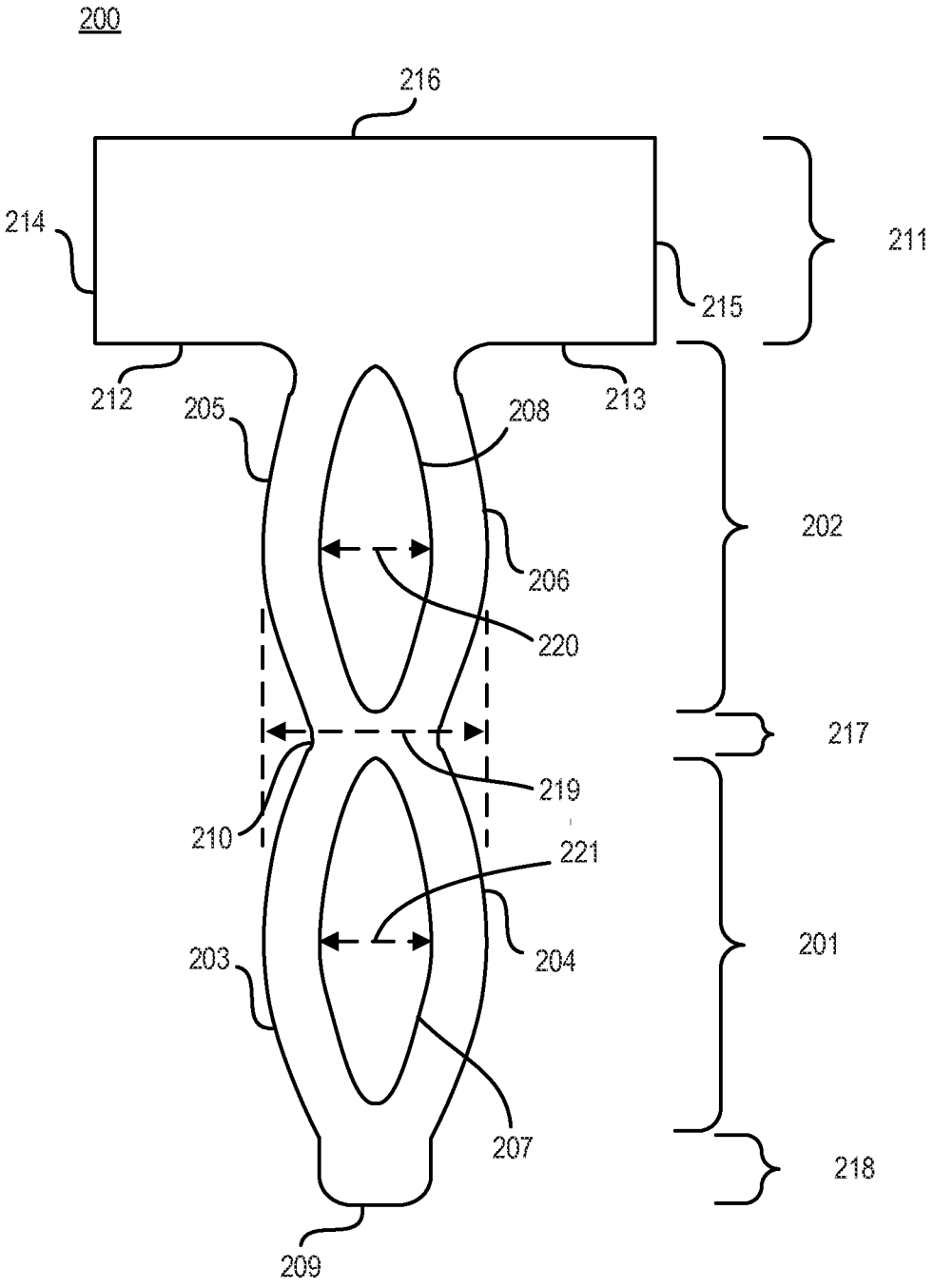
FIG. 2 is an elevation view diagram of a double action compliant connector pin according to an embodiment of the present disclosure.

FIG. 2 is an elevation view diagram of a double action compliant connector pin according to an embodiment of the present disclosure. Electrical connector pin 200 is a double action compliant connector pin. Electrical connector pin 200 comprises a tip region 218, a first contact portion 201, a junction region 217, a second contact portion 202, and a base region 211. First contact portion 201 comprises a first arched flexure element 203 and a second arched flexure element 204. Second arched flexure element 204 is disposed in lateral opposition to first arched flexure element 203. Second contact portion 202 comprises third arched flexure element 205 and fourth arched flexure element 206. Fourth arched flexure element 206 is disposed in lateral opposition to third arched flexure element 205. Second contact portion 202 is disposed in tandem with the first contact portion 201.

First contact portion 201 defines a first aperture 207 disposed between first arched flexure element 203 and second arched flexure element 204. Second contact portion 202 defines a second aperture 208 disposed between third arched flexure element 205 and fourth arched flexure element 206. In accordance with one embodiment, first aperture 207 and second aperture 208 are defined to be of a substantially identical size. In accordance with one embodiment, first aperture 207 and second aperture 208 have an elongated shape, for example, an "eye" shape, as opposed to a circular shape. In accordance with one embodiment, first aperture 207 and second aperture 208 share a common major axis which is longer than both a minor axis of first aperture 207 and a minor axis of second aperture 208, where the minor axes are perpendicular to the common major axis. In accordance with one embodiment, first contact portion 201 and second contact portion 202 lie in a substantially identical plane.

In accordance with one embodiment, tip region 218 comprises a rounded tip 209 disposed at a first end of first contact portion 201. Tip region 218 connects a first end of first arched flexure element 203 and a first end of second arched flexure element 204. Junction region 217 is disposed between a second end of the first contact portion and a first end of the second contact portion. Neither first aperture 207 nor second aperture 208 is defined within junction region 217. Rather, junction region 217 comprises junction portion 210. Junction portion 210 connects a second end of first arched flexure element 203, a second end of second arched flexure element 204, a first end of third arched flexure element 205, and a first end of a fourth arched flexure element 206. Base region 211 is disposed at second end of second contact portion 202. Base region 211 connects a second end of third arched flexure element 205 and a second end of fourth arched flexure element 206. Base region 211 defines a transverse shoulder. The transverse shoulder comprises a first transverse shoulder portion 212 and a second transverse shoulder portion 213. In accordance with one embodiment, the transverse shoulder bears against a connector body. The transverse shoulder bearing against the connector body can limit an insertion depth of electrical connector pin 200 and can transfer extraction force from the connector body to electrical connector pin 200 to facilitate extraction of electrical connector pin 200. Base region 211 also defines edges 214, 215, and 216, such that base region 211 may be of, for example, a rectangular shape.

Electrical connector pin 200 is a double action compliant connector pin, as the opposing flexure of first arched flexure element 203 and second arched flexure element 204 provides a first action allowing compliance of first arched flexure element 203 and second arched flexure element 204 to a first portion of an inside surface of a receptacle, such as a plated-through via, and the opposing flexure of third arched flexure element 205 and fourth arched flexure element 206 provides a second action allowing compliance of third arched flexure element 205 and fourth arched flexure element 206 to a second portion of the inside surface of the receptacle. As an example, an inside diameter of the receptacle can be slightly smaller than a width 219 of the outer edges of first contact portion 201 and second contact portion 202. The smaller diameter of the receptacle can cause arched flexure elements 203-206 to flex and apply spring bias against the inside surface of the receptacle to provide gas-tight electrical and mechanical connections between the electrical connector pin and the receptacle.

In accordance with one example, a width 221 of first aperture 207 is substantially identical to a width 220 of second aperture 208. In accordance with at least one embodiment, a width of first arched flexure element 203 and second arched flexure element 204 is substantially identical to a width of third arched flexure element 205 and fourth arched flexure element 206.

Figure 3:
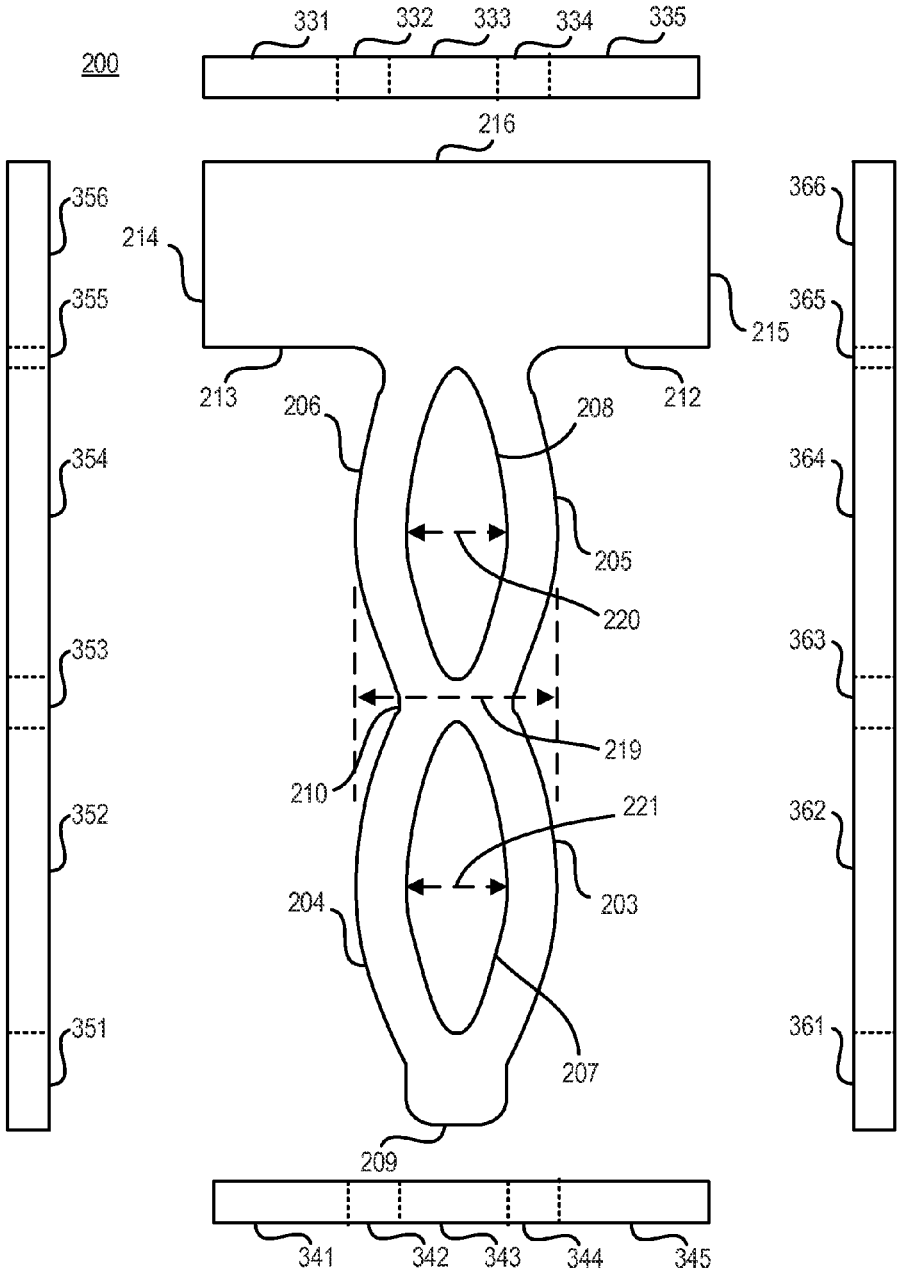
FIG. 3 is an orthographic projection view diagram of the double action compliant connector pin according to the embodiment of FIG. 2.

FIG. 3 is an orthographic projection view diagram of the double action compliant connector pin according to the embodiment of FIG. 2. While FIG. 2 illustrates a first surface of a double action compliant connector pin, FIG. 3 illustrates a second, third, fourth, fifth, and sixth surface of the double action compliant connector pin of FIG. 2. A second surface opposite the first surface illustrated in FIG. 2 is substantially identical to the first surface. A third surface as viewed from the left side of the first surface illustrated in FIG. 2 is substantially rectangular. The third surface includes a first portion 361, a second portion 362, a third portion 363, a fourth portion 364, a fifth portion 365, and a sixth portion 366. First portion 361 corresponds to a portion of the electrical connector pin between tip portion 209 and aperture 207. Second portion 362 corresponds to a portion of the electrical connector pin spanning a height of aperture 207. Third portion 363 corresponds to a portion of the electrical connector pin spanning junction region 217. Fourth portion 364 corresponds to a portion of the electrical connector pin spanning a height of aperture 208. Fifth portion 365 corresponds to a portion of the electrical connector pin between aperture 208 and the lateral shoulder of base region 211. Sixth portion 363 corresponds to a portion of the electrical connector pin spanning base region 211.

A fourth surface as viewed from the right side of the first surface illustrated in FIG. 2 is substantially rectangular. The fourth surface includes a first portion 351, a second portion 352, a third portion 353, a fourth portion 354, a fifth portion 355, and a sixth portion 356. First portion 351 corresponds to a portion of the electrical connector pin between tip portion 209 and aperture 207. Second portion 352 corresponds to a portion of the electrical connector pin spanning a height of aperture 207. Third portion 353 corresponds to a portion of the electrical connector pin spanning junction region 217. Fourth portion 354 corresponds to a portion of the electrical connector pin spanning a height of aperture 208. Fifth portion 355 corresponds to a portion of the electrical connector pin between aperture 208 and the lateral shoulder of base region 211. Sixth portion 356 corresponds to a portion of the electrical connector pin spanning base region 211.

A fifth surface as viewed from the top of the first surface illustrated in FIG. 2 is substantially rectangular. The fifth surface includes a first portion 331, a second portion 332, a third portion 333, a fourth portion 334, and a fifth portion 335. First portion 331 corresponds to a portion between edge 214 of base region 211 and an outside edge at a peak of third arched flexure element 205. Second portion 332 corresponds a portion between the outside edge and an inside edge at the peak of third arched flexure element 205. Third portion 333 corresponds to a portion spanning a width 220 of aperture 208. Fourth portion 334 corresponds to a portion between an inside edge and an outside edge at the peak of fourth arched flexure element 206. Fifth portion 335 corresponds to a portion between the outside edge at the peak of fourth arched flexure element 206 and edge 215 of base region 211.

A sixth surface as viewed from the bottom of the first surface illustrated in FIG. 2 is substantially rectangular. The sixth surface includes a first portion 341, a second portion 342, a third portion 343, a fourth portion 344, and a fifth portion 345. First portion 341 corresponds to a portion between edge 214 of base region 211 and an outside edge at a peak of first arched flexure element 203. Second portion 342 corresponds a portion between the outside edge and an inside edge at the peak of first arched flexure element 203. Third portion 343 corresponds to a portion spanning a width 221 of aperture 207. Fourth portion 344 corresponds to a portion between an inside edge and an outside edge at the peak of second arched flexure element 204. Fifth portion 345 corresponds to a portion between the outside edge at the peak of second arched flexure element 204 and edge 215 of base region 211.

Figure 4:
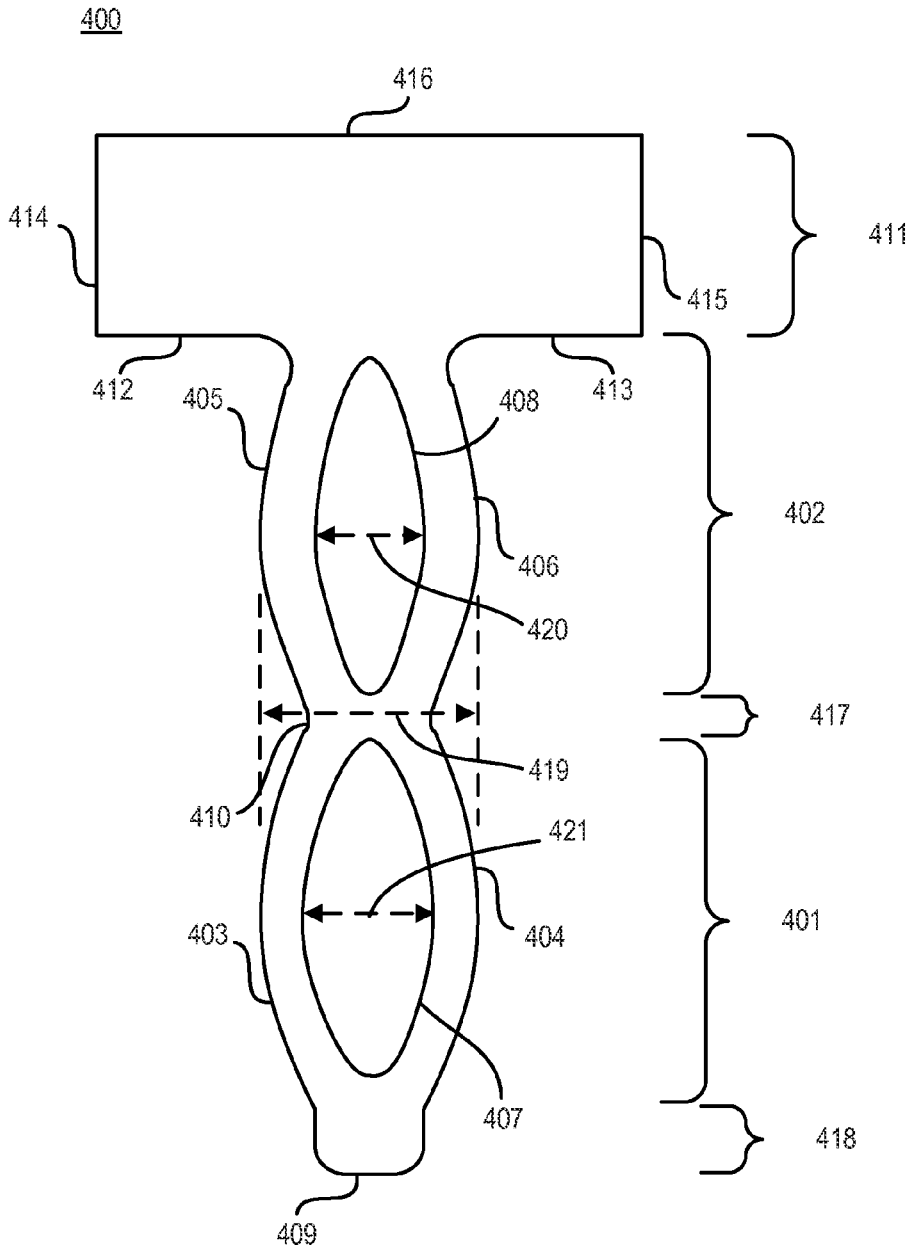
FIG. 4 is an elevation view diagram of a double action compliant connector pin according to an embodiment of the present disclosure.

FIG. 4 is an elevation view diagram of a double action compliant connector pin according to an embodiment of the present disclosure. Electrical connector pin 400 is a double action compliant connector pin. Electrical connector pin 400 is similar to electrical connector pin 200 of FIG. 2, except first aperture 407 is defined to be of a larger size and second aperture 408 is defined to be of a smaller size. Electrical connector pin 400 comprises a tip region 418, a first contact portion 401, a junction region 417, a second contact portion 402, and a base region 411. First contact portion 401 comprises a first arched flexure element 403 and a second arched flexure element 404. Second arched flexure element 404 is disposed in lateral opposition to first arched flexure element 403. Second contact portion 402 comprises third arched flexure element 405 and fourth arched flexure element 406. Fourth arched flexure element 406 is disposed in lateral opposition to third arched flexure element 405. Second contact portion 402 is disposed in tandem with the first contact portion 401.

First contact portion 401 defines a first aperture 407 disposed between first arched flexure element 403 and second arched flexure element 404. Second contact portion 402 defines a second aperture 408 disposed between third arched flexure element 405 and fourth arched flexure element 406. In accordance with one embodiment, first aperture 407 has a width 421, and second aperture 408 has a width 420, wherein width 421 of first aperture 407 is greater than width 420 of second aperture 408. In accordance with one embodiment, first contact portion 401 and second contact portion 402 lie in a substantially identical plane.

In accordance with one embodiment, tip region 418 comprises a rounded tip 409 disposed at a first end of first contact portion 401. Tip region 418 connects a first end of first arched flexure element 403 and a first end of second arched flexure element 404. Junction region 417 is disposed between a second end of the first contact portion and a first end of the second contact portion. Neither first aperture 407 nor second aperture 408 is defined within junction region 417. Rather, junction region 417 comprises junction portion 410. Junction portion 410 connects a second end of first arched flexure element 403, a second end of second arched flexure element 404, a first end of third arched flexure element 405, and a first end of a fourth arched flexure element 406. Base region 411 is disposed at second end of second contact portion 402. Base region 411 connects a second end of third arched flexure element 405 and a second end of fourth arched flexure element 406. Base region 411 defines a transverse shoulder. The transverse shoulder comprises a first transverse shoulder portion 412 and a second transverse shoulder portion 413. In accordance with one embodiment, the transverse shoulder bears against a connector body. The transverse shoulder bearing against the connector body can limit an insertion depth of electrical connector pin 400 and can transfer extraction force from the connector body to electrical connector pin 200 to facilitate extraction of electrical connector pin 400. Base region 411 also defines edges 414, 415, and 416, such that base region 411 may be of, for example, a rectangular shape.

Electrical connector pin 400 is a double action compliant connector pin, as the opposing flexure of first arched flexure element 403 and second arched flexure element 404 provides a first action allowing compliance of first arched flexure element 403 and second arched flexure element 404 to a first portion of an inside surface of a receptacle, such as a plated-through via, and the opposing flexure of third arched flexure element 405 and fourth arched flexure element 406 provides a second action allowing compliance of third arched flexure element 405 and fourth arched flexure element 406 to a second portion of the inside surface of the receptacle. As an example, an inside diameter of the receptacle can be slightly smaller than a width 419 of the outer edges of first contact portion 401 and second contact portion 402. The smaller diameter of the receptacle can cause arched flexure elements 403-406 to flex and apply spring bias against the inside surface of the receptacle to provide gas-tight electrical and mechanical connections between the electrical connector pin and the receptacle.

In accordance with one example, a width 421 of first aperture 407 is greater than a width 420 of second aperture 408. In accordance with at least one embodiment, a width of first arched flexure element 403 and second arched flexure element 404 is less than a width of third arched flexure element 405 and fourth arched flexure element 406.

Figure 5:
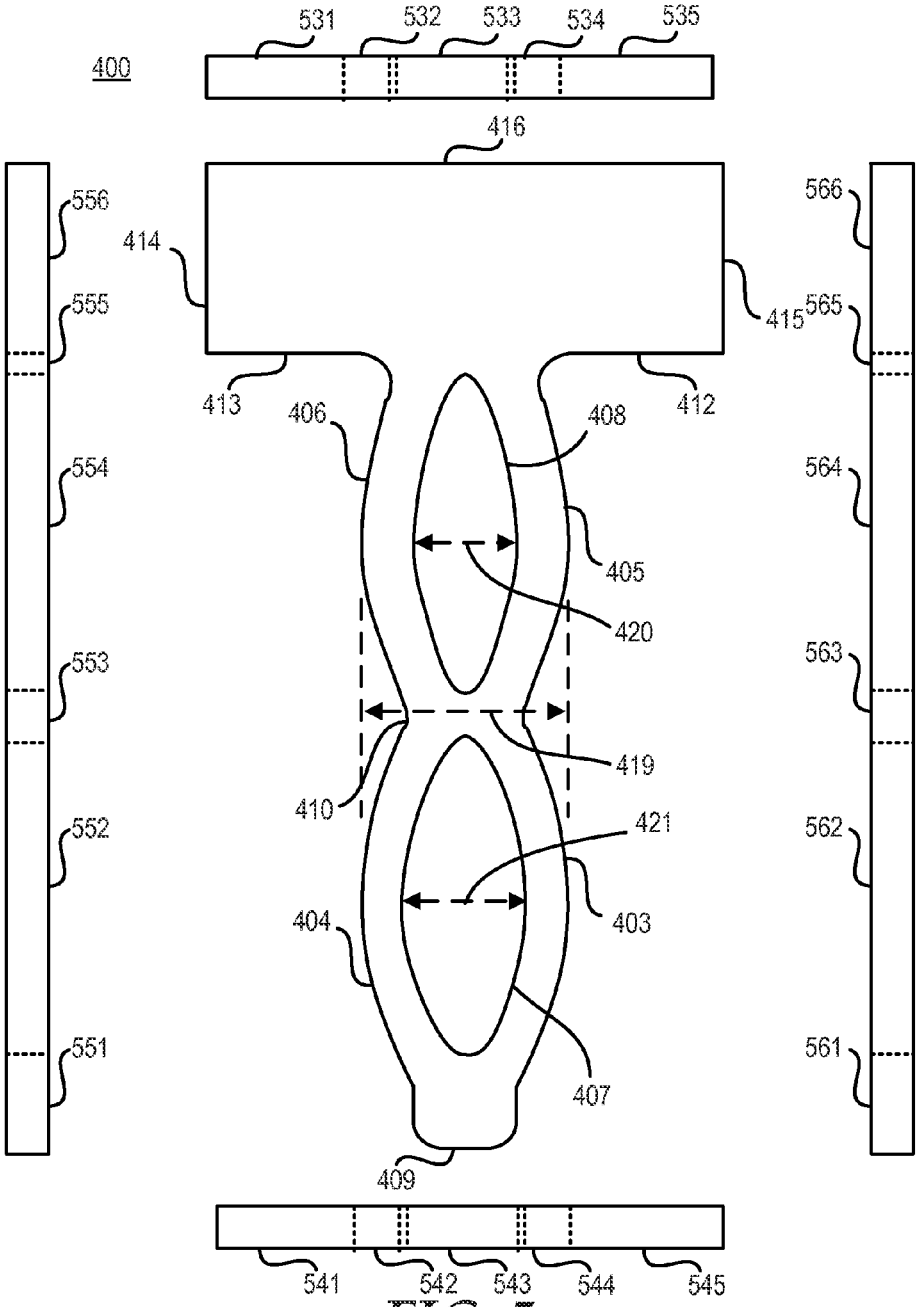
FIG. 5 is an orthographic projection view diagram of the double action compliant connector pin according to the embodiment of FIG. 4.

FIG. 5 is an orthographic projection view diagram of the double action compliant connector pin according to the embodiment of FIG. 4. While FIG. 4 illustrates a first surface of a double action compliant connector pin, FIG. 5 illustrates a second, third, fourth, fifth, and sixth surface of the double action compliant connector pin of FIG. 4. A second surface opposite the first surface illustrated in FIG. 4 is substantially identical to the first surface. A third surface as viewed from the left side of the first surface illustrated in FIG. 4 is substantially rectangular. The third surface includes a first portion 561, a second portion 562, a third portion 563, a fourth portion 564, a fifth portion 565, and a sixth portion 566. First portion 561 corresponds to a portion of the electrical connector pin between tip portion 409 and aperture 407. Second portion 562 corresponds to a portion of the electrical connector pin spanning a height of aperture 407. Third portion 563 corresponds to a portion of the electrical connector pin spanning junction region 417. Fourth portion 564 corresponds to a portion of the electrical connector pin spanning a height of aperture 408. Fifth portion 565 corresponds to a portion of the electrical connector pin between aperture 408 and the lateral shoulder of base region 411. Sixth portion 563 corresponds to a portion of the electrical connector pin spanning base region 411.

A fourth surface as viewed from the right side of the first surface illustrated in FIG. 4 is substantially rectangular. The fourth surface includes a first portion 351, a second portion 552, a third portion 553, a fourth portion 554, a fifth portion 555, and a sixth portion 556. First portion 551 corresponds to a portion of the electrical connector pin between tip portion 409 and aperture 407. Second portion 552 corresponds to a portion of the electrical connector pin spanning a height of aperture 407. Third portion 553 corresponds to a portion of the electrical connector pin spanning junction region 417. Fourth portion 554 corresponds to a portion of the electrical connector pin spanning a height of aperture 408. Fifth portion 555 corresponds to a portion of the electrical connector pin between aperture 408 and the lateral shoulder of base region 411. Sixth portion 556 corresponds to a portion of the electrical connector pin spanning base region 411.

A fifth surface as viewed from the top of the first surface illustrated in FIG. 4 is substantially rectangular. The fifth surface includes a first portion 531, a second portion 532, a third portion 533, a fourth portion 534, and a fifth portion 535. First portion 531 corresponds to a portion between edge 414 of base region 411 and an outside edge at a peak of third arched flexure element 405. Second portion 532 corresponds a portion between the outside edge and an inside edge at the peak of third arched flexure element 405. Third portion 533 corresponds to a portion spanning a width 420 of aperture 408. Fourth portion 534 corresponds to a portion between an inside edge and an outside edge at the peak of fourth arched flexure element 406. Fifth portion 535 corresponds to a portion between the outside edge at the peak of fourth arched flexure element 406 and edge 415 of base region 411.

A sixth surface as viewed from the bottom of the first surface illustrated in FIG. 4 is substantially rectangular. The sixth surface includes a first portion 541, a second portion 542, a third portion 543, a fourth portion 544, and a fifth portion 545. First portion 541 corresponds to a portion between edge 414 of base region 411 and an outside edge at a peak of first arched flexure element 403. Second portion 542 corresponds a portion between the outside edge and an inside edge at the peak of first arched flexure element 403. Third portion 543 corresponds to a portion spanning a width 421 of aperture 407. Fourth portion 544 corresponds to a portion between an inside edge and an outside edge at the peak of second arched flexure element 404. Fifth portion 545 corresponds to a portion between the outside edge at the peak of second arched flexure element 404 and edge 415 of base region 411.

Figure 6:
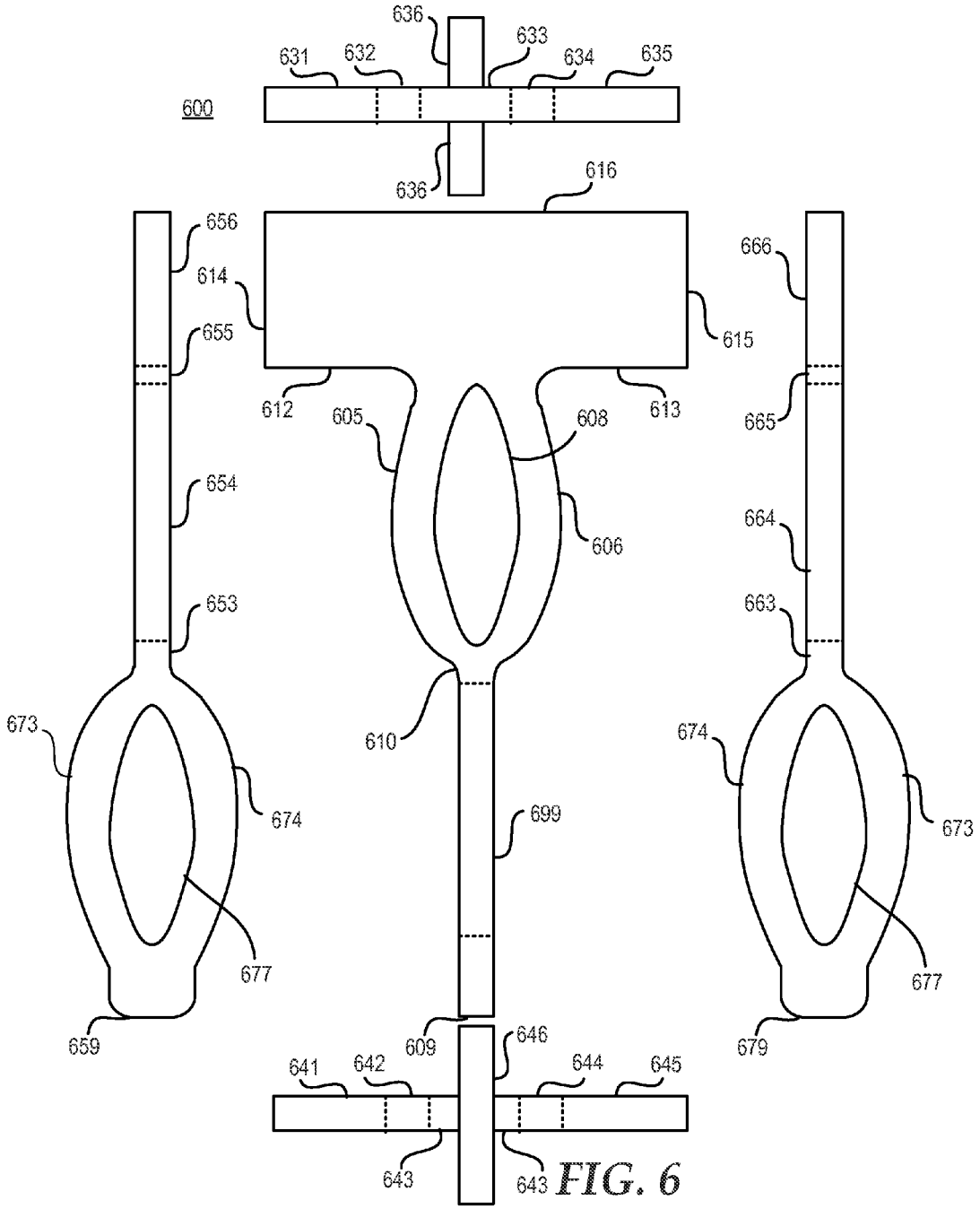
FIG. 6 is an orthographic projection view diagram of the double action compliant connector pin according to an embodiment of the present disclosure.

FIG. 6 is an orthographic projection view diagram of the double action compliant connector pin according to an embodiment of the present disclosure. Electrical connector pin 600 is a double action compliant connector pin. Electrical connector pin 600 can be similar to either electrical connector pin 200 or electrical connector pin 400, except a first contact portion and a second contact portion lie in different planes. Electrical connector pin 600 comprises a tip region, a first contact portion, a junction region, a second contact portion, and a base region. The first contact portion 699 is disposed between rounded tip 609 of the tip region and junction portion 610 of the junction region. The first contact portion comprising a first arched flexure element and a second arched flexure element will be described in further detail below. The second contact portion comprises third arched flexure element 605 and fourth arched flexure element 606. Fourth arched flexure element 606 is disposed in lateral opposition to third arched flexure element 605. The second contact portion is disposed in tandem with the first contact portion.

The second contact portion defines a second aperture 608 disposed between third arched flexure element 605 and fourth arched flexure element 606. In accordance with one embodiment, first aperture 607 and second aperture 608 are defined to be of a substantially identical size. In accordance with one embodiment, first aperture 607 is of a larger size than second aperture 608. In accordance with one embodiment, the first contact portion and the second contact portion lie in different planes. As an example, a first plane of the first contact portion differs from a second plane of the second contact portion by an angular offset. As an example, the angular offset is between five and ninety degrees. As an example, the angular offset is relative to an axis of symmetry of the electrical connector pin.

In accordance with one embodiment, a tip region comprises a rounded tip 609 disposed at a first end of the first contact portion. First contact portion 699 is disposed between rounded tip 609 and junction portion 610. Second aperture 608 is defined within the junction region. The junction region comprises junction portion 610. Junction portion 610 connects first contact portion 699, a first end of third arched flexure element 605, and a first end of a fourth arched flexure element 606. A base region is disposed at a second end of second contact portion 602. The base region connects a second end of third arched flexure element 605 and a second end of fourth arched flexure element 606. The base region defines a transverse shoulder. The transverse shoulder comprises a first transverse shoulder portion 612 and a second transverse shoulder portion 613. In accordance with one embodiment, the transverse shoulder bears against a connector body. The transverse shoulder bearing against the connector body can limit an insertion depth of electrical connector pin 600 and can transfer extraction force from the connector body to electrical connector pin 600 to facilitate extraction of electrical connector pin 600. The base region also defines edges 614, 615, and 616, such that the base region may be of, for example, a rectangular shape.

A first surface of electrical connector pin 600 is described above. A second surface opposite the first surface is substantially identical to the first surface. A third surface as viewed from the right side of the first surface illustrated in FIG. 6 includes a rounded tip 679 (illustrated as rounded tip 609 with respect to the first surface), the first contact portion, the junction portion, a first substantially rectangular portion 664, a second substantially rectangular portion 665, and a third substantially rectangular portion 666. The first contact portion, along the second surface, comprises a first arched flexure element 673 and a second arched flexure element 674. First arched flexure element 673 and fourth arched flexure element 674 define, along the second surface, aperture 677. The junction region comprises, along the second surface, junction portion 663. First substantially rectangular portion 664 corresponds to the second contact portion. Second substantially rectangular portion 665 corresponds to a portion of the electrical connector pin between aperture 608 and the lateral shoulder of the base region. Third substantially rectangular portion 666 corresponds to a portion of the electrical connector pin spanning the base region.

A fourth surface as viewed from the left side of the first surface illustrated in FIG. 6 includes a rounded tip 659 (illustrated as rounded tip 609 with respect to the first surface and rounded tip 679 with respect to the second surface), the first contact portion, the junction portion, a first substantially rectangular portion 654, a second substantially rectangular portion 655, and a third substantially rectangular portion 656. The first contact portion, along the second surface, comprises a first arched flexure element 673 and a second arched flexure element 674. First arched flexure element 673 and fourth arched flexure element 674 define, along the second surface, aperture 677. The junction region comprises, along the second surface, junction portion 653. First substantially rectangular portion 654 corresponds to the second contact portion. Second substantially rectangular portion 655 corresponds to a portion of the electrical connector pin between aperture 608 and the lateral shoulder of the base region. Third substantially rectangular portion 656 corresponds to a portion of the electrical connector pin spanning the base region.

A fifth surface as viewed from the top of the first surface illustrated in FIG. 6 is substantially cruciform as a result of the twist between the first contact portion and the second contact portion. The fifth surface includes a first portion 631, a second portion 632, a third portion 633, a fourth portion 634, a fifth portion 635, and a sixth portion 636. First portion 631 corresponds to a portion between edge 614 of the base region and an outside edge at a peak of third arched flexure element 605. Second portion 632 corresponds a portion between the outside edge and an inside edge at the peak of third arched flexure element 605. Third portion 633 corresponds to a portion spanning a width 620 of aperture 608. Fourth portion 634 corresponds to a portion between an inside edge and an outside edge at the peak of fourth arched flexure element 606. Fifth portion 635 corresponds to a portion between the outside edge at the peak of fourth arched flexure element 606 and edge 615 of the base region. Sixth portion 636 corresponds to first contact portion 699.

A sixth surface as viewed from the bottom of the first surface illustrated in FIG. 6 is substantially cruciform as a result of the twist between the first contact portion and the second contact portion. The sixth surface includes a first portion 641, a second portion 642, a third portion 643, a fourth portion 644, a fifth portion 645, and a sixth portion 646. First portion 641 corresponds to a portion between edge 614 of the base region and an outside edge at a peak of first arched flexure element 603. Second portion 642 corresponds a portion between the outside edge and an inside edge at the peak of first arched flexure element 603. Third portion 643 corresponds to a portion spanning a width 621 of aperture 607. Fourth portion 344 corresponds to a portion between an inside edge and an outside edge at the peak of second arched flexure element 604. Fifth portion 645 corresponds to a portion between the outside edge at the peak of second arched flexure element 604 and edge 615 of the base region. Sixth portion 646 corresponds to rounded tip 609 and first contact portion 699.

In accordance with one example, a width of first aperture 677 is substantially identical to a width of second aperture 608. In accordance with at least one embodiment, a width of first arched flexure element 673 and second arched flexure element 674 is substantially identical to a width of third arched flexure element 605 and fourth arched flexure element 606. In accordance with at least one embodiment, a width of first arched flexure element 673 and second arched flexure element 674 is larger than a width of third arched flexure element 605 and fourth arched flexure element 606.

Figure 7:
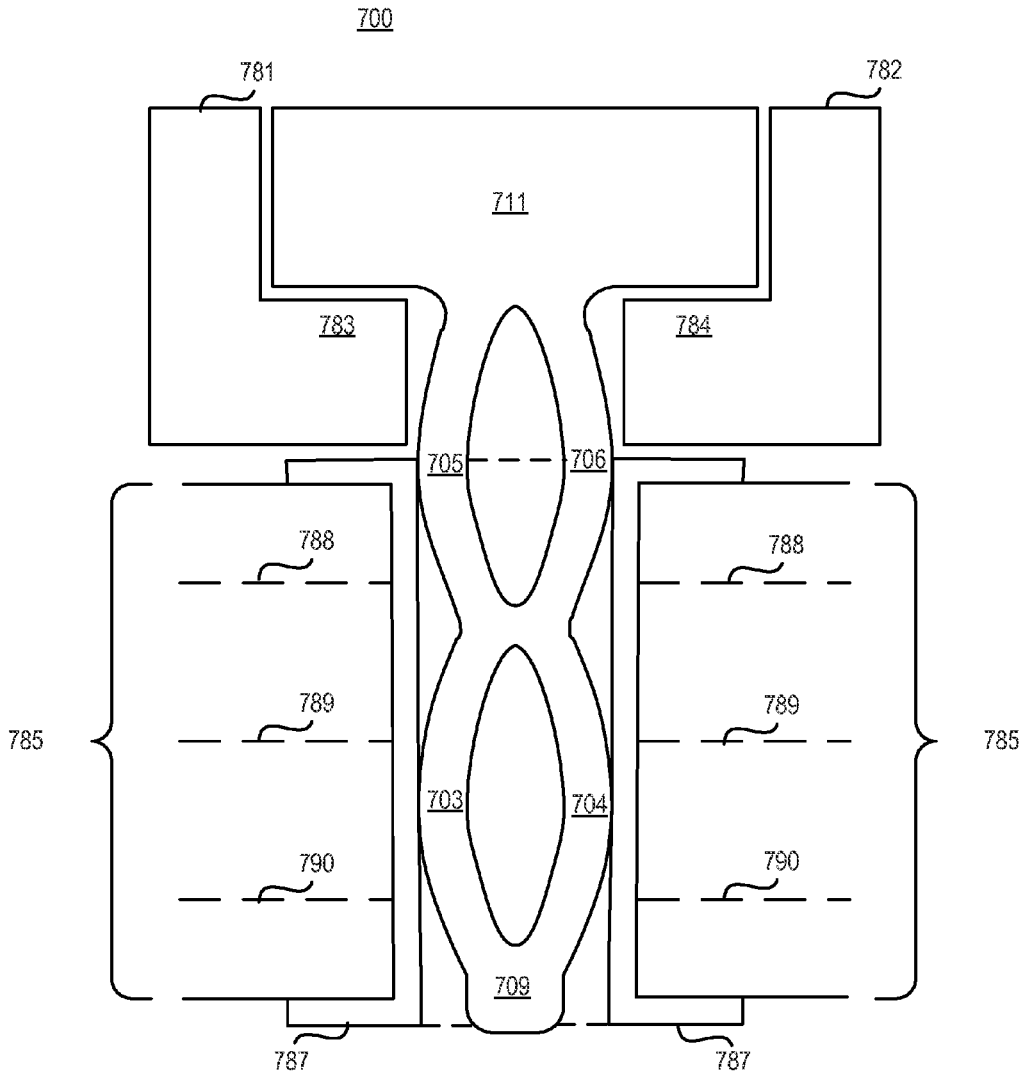
FIG. 7 is a cross sectional elevation view diagram of a double action compliant connector pin inserted into a receptacle according to an embodiment of the present disclosure.

FIG. 7 is a cross sectional elevation view diagram of a double action compliant connector pin inserted into a receptacle according to an embodiment of the present disclosure. Interconnection 700 comprises an electrical connector pin, a connector body, a circuit board 785, and a receptacle. The electrical connector pin comprises tip portion 709, first arched flexure element 703, second arched flexure element 704, third arched flexure element 705, fourth arched flexure element 706, and base region 711. The connector body comprises first portion 781 and second portion 782. First portion 781 defines a first lateral shoulder portion 783 to bear upon a first lateral shoulder portion of base region 711. Second portion 782 defines a second lateral shoulder portion 784 to bear upon a second lateral shoulder portion of base portion 711. The circuit board 785 comprises a plurality of conductive layers 788, 789, and 790 separated from each other by a dielectric material. A receptacle 787 is disposed in circuit board 785. As an example, receptacle 787 can be a plated-through via. Receptacle 787 can be electrically connected to one or more of conductive layer s 788, 789, and 790. The connector body can bear upon a surface of receptacle 787 to position the electrical connector pin relative to receptacle 787. As an example, the peaks of third arched flexure element 705 and fourth arched flexure element 706 can be positioned to bear upon receptacle 787 at or near a first end of receptacle 787. The peaks of first arched flexure element 703 and second arched flexure element 704 can be positioned inside an interior of receptacle 787 closer to a second end of receptacle 787 than would occur with a connector pin having only a first contact region rather than first and second contact regions. By providing the first and second contact regions, the electrical connector pin provides multiple points of contact. The multiple points of contact minimize the distance from at least one point of contact to a conductive layer connected to receptacle 787 regardless of the position of the conductive layer along the depth of receptacle 787. Accordingly, both the magnitude and path length of impedance discontinuities introduced by interconnection 700 can be minimized, and signals conforming to interface protocols requiring higher frequencies can be accurately communicated.

Figure 8:
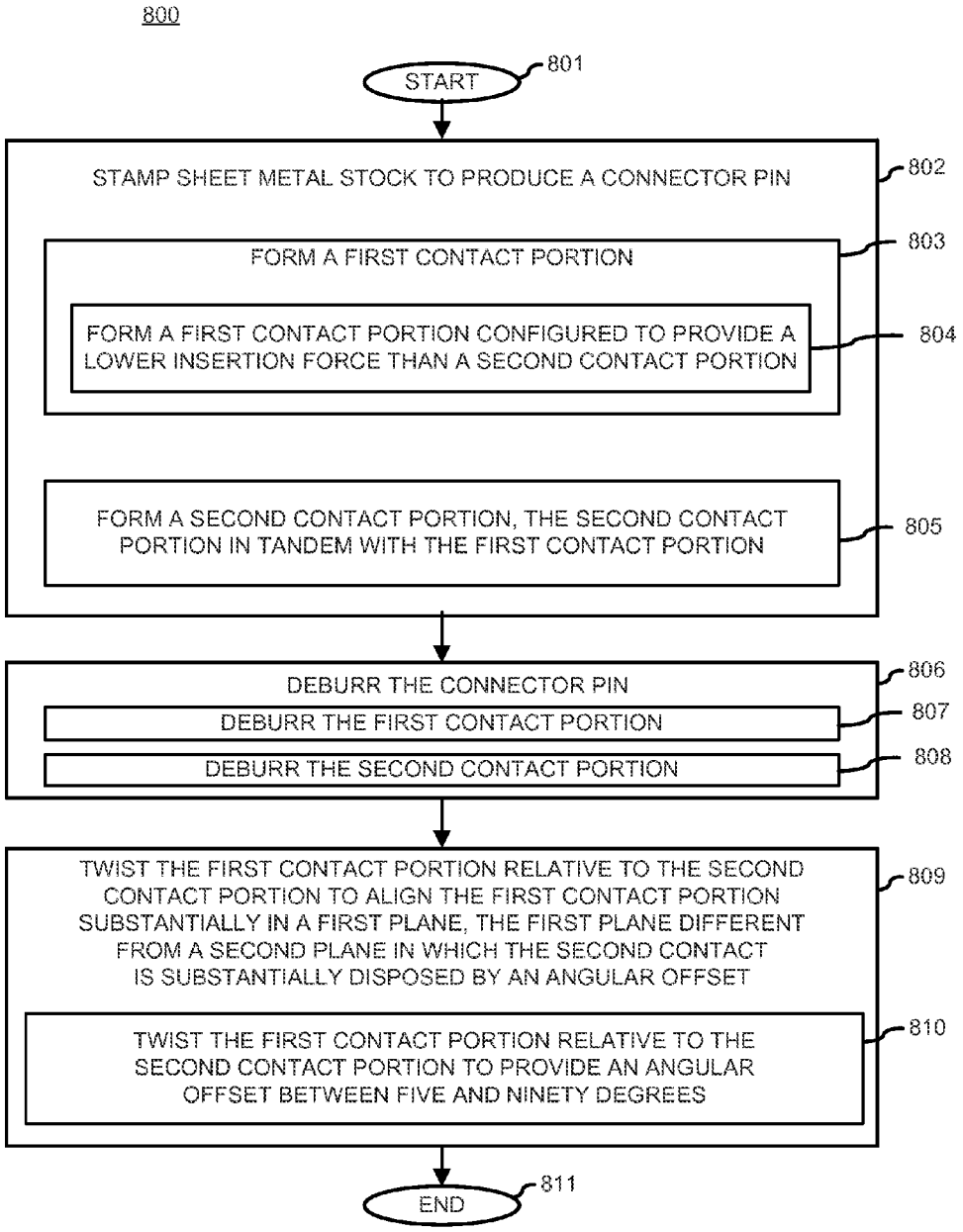
FIG. 8 is a flow diagram illustrating a method of manufacture for a connector pin according to an embodiment of the present disclosure.

FIG. 8 is a flow diagram illustrating a method of manufacture for a connector pin according to an embodiment of the present disclosure. Method 800 begins at block 801. From block 801, method 800 continues to block 802. In block 802, sheet metal stock is stamped to produce a connector pin. Block 802 can comprise block 803 and block 805. In block 803, a first contact portion is formed. Block 803 can comprise block 804. In block 804, the first contact portion is formed so as to be configured to provide a lower insertion force than a second contact portion. In block 805, a second contact portion is formed such that the second contact portion is in tandem with the first contact portion. Thus, upon insertion into a receptacle, both the first contact portion and the second contact portion can provide electrical and mechanical connections with the receptacle, with the connection of the first contact portion occurring at a different depth within the receptacle than the connection of the second contact portion. Any or all of blocks 803, 804, and 805 can be performed simultaneously with block 802 or at different times. From block 802, method 800 continues to block 806. In block 806, the connector pin is deburred.

Block 806 can comprise blocks 807 and 808. In block 807, the first contact portion is deburred. In block 808, the second contact portion is deburred. Blocks 806, 807, and 808 can be performed simultaneously or at different times. From block 806, method 800 continues to block 809. In block 809, the first contact portion is twisted relative to the second contact portion. The twisting aligns the first contact portion substantially in a first plane. The first plane is different from a second plane in which the second contact is substantially disposed. The first plane is different from the second plane by an angular offset. Block 809 can comprise block 810. In block 810, the twisting of the first contact portion relative to the second contact portion provides an angular offset between five and ninety degrees. From block 809, method 800 continues to block 811, where method 800 ends.

In accordance with at least one embodiment, an information handling system comprises a circuit board defining a plated-through via and a connector pin configured to be installed in the plated-through via. The connector pin comprises a first contact portion and a second contact portion. The first contact portion comprises a first arched flexure element and a second arched flexure element disposed in lateral opposition to the first arched flexure element. The second contact portion comprises a third arched flexure element and a fourth arched flexure element disposed in lateral opposition to the third arched flexure element. The second contact portion disposed in tandem with the first contact portion. In accordance with at least one embodiment, the first contact portion defines a first aperture disposed between the first arched flexure element and the second arched flexure element, wherein the second contact portion defines a second aperture disposed between the third arched flexure element and the fourth arched flexure element.

In accordance with at least one embodiment, the first aperture and the second aperture are defined to be of a substantially identical size. In accordance with at least one embodiment, the first aperture is defined to be of a larger size and the second aperture is defined to be a smaller size. In accordance with at least one embodiment, the first contact portion and the second contact portion lie in a substantially identical plane. In accordance with at least one embodiment, the first contact portion and the second contact portion lie in different planes. In accordance with at least one embodiment, the connector pin further comprises a rounded tip region disposed at a first end of the first contact portion, a junction region between the first contact portion and the second contact portion, the junction region disposed between a second end of the first contact portion and a first end of the second contact portion, and a base region disposed at second end of the second contact portion, the base region defining a transverse shoulder.

While the computer-readable medium is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding, or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to store information received via carrier wave signals such as a signal communicated over a transmission medium. Furthermore, a computer readable medium can store information received from distributed network resources such as from a cloud-based environment. A digital file attachment to an e-mail or other self-contained information archive or set of archives may be considered a distribution medium that is equivalent to a tangible storage medium. Accordingly, the disclosure is considered to include any one or more of a computer-readable medium or a distribution medium and other equivalents and successor media, in which data or instructions may be stored.

In the embodiments described herein, an information handling system includes any instrumentality or aggregate of instrumentalities operable to compute, classify, process, transmit, receive, retrieve, originate, switch, store, display, manifest, detect, record, reproduce, handle, or use any form of information, intelligence, or data for business, scientific, control, entertainment, or other purposes. For example, an information handling system can be a personal computer, a consumer electronic device, a network server or storage device, a switch router, wireless router, or other network communication device, a network connected device (cellular telephone, tablet device, etc.), or any other suitable device, and can vary in size, shape, performance, price, and functionality.

The information handling system can include memory (volatile (e.g. random-access memory, etc.), nonvolatile (read-only memory, flash memory etc.) or any combination thereof), one or more processing resources, such as a central processing unit (CPU), a graphics processing unit (GPU), hardware or software control logic, or any combination thereof. Additional components of the information handling system can include one or more storage devices, one or more communications ports for communicating with external devices, as well as, various input and output (I/O) devices, such as a keyboard, a mouse, a video/graphic display, or any combination thereof. The information handling system can also include one or more buses operable to transmit communications between the various hardware components. Portions of an information handling system may themselves be considered information handling systems.

When referred to as a "device," a "module," or the like, the embodiments described herein can be configured as hardware. For example, a portion of an information handling system device may be hardware such as, for example, an integrated circuit (such as an Application Specific Integrated Circuit (ASIC), a Field Programmable Gate Array (FPGA), a structured ASIC, or a device embedded on a larger chip), a card (such as a Peripheral Component Interface (PCI) card, a PCI-express card, a Personal Computer Memory Card International Association (PCMCIA) card, or other such expansion card), or a system (such as a motherboard, a system-on-a-chip (SoC), or a stand-alone device).

The device or module can include software, including firmware embedded at a device, such as a Pentium class or PowerPC™ brand processor, or other such device, or software capable of operating a relevant environment of the information handling system. The device or module can also include a combination of the foregoing examples of hardware or software. Note that an information handling system can include an integrated circuit or a board-level product having portions thereof that can also be any combination of hardware and software.

Devices, modules, resources, or programs that are in communication with one another need not be in continuous communication with each other, unless expressly specified otherwise. In addition, devices, modules, resources, or programs that are in communication with one another can communicate directly or indirectly through one or more intermediaries.

Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

What is claimed is:

1. An interconnection comprising:

a connector body; and an electrical connector pin, the electrical connector pin including:

a first contact portion comprising:

a first arched flexure element; and a second arched flexure element disposed in lateral opposition to the first arched flexure element; and a second contact portion comprising:

a third arched flexure element; and a fourth arched flexure element disposed in lateral opposition to the third arched flexure element, the second contact portion disposed in tandem with the first contact portion, wherein a portion of the third arched flexure element and the fourth arched flexure element is disposed within the connector body to position peaks of the third arched flexure element and the fourth arched flexure element to bear upon a receptacle at or near a first end of the receptacle.

2. The interconnection of claim 1 wherein the first contact portion defines a first aperture disposed between the first arched flexure element and the second arched flexure element and wherein the second contact portion defines a second aperture disposed between the third arched flexure element and the fourth arched flexure element.

3. The interconnection of claim 2 wherein the first aperture and the second aperture are defined to be of a substantially identical size.

4. The interconnection of claim 2 wherein the first aperture is defined to be of a larger size and the second aperture is defined to be of a smaller size.

5. The interconnection of claim 1 wherein the first contact portion and the second contact portion lie in a substantially identical plane.

6. The interconnection of claim 1 wherein the first contact portion and the second contact portion lie in different planes.

7. The interconnection of claim 1 further comprising:

a rounded tip region disposed at a first end of the first contact portion;

a junction region between the first contact portion and the second contact portion, the junction region disposed between a second end of the first contact portion and a first end of the second contact portion; and a base region disposed at second end of the second contact portion, the base region defining a transverse shoulder.

8. An information handling system comprising:

a circuit board defining a plated-through via;

a connector body;

a connector pin configured to be installed in the plated-through via, the connector pin comprising:

a first contact portion comprising:

a first arched flexure element; and a second arched flexure element disposed in lateral opposition to the first arched flexure element; and a second contact portion comprising:

a third arched flexure element; and a fourth arched flexure element disposed in lateral opposition to the third arched flexure element, the second contact portion disposed in tandem with the first contact portion, wherein a portion of the third arched flexure element and the fourth arched flexure element is disposed within the connector body to position peaks of the third arched flexure element and the fourth arched flexure element to bear upon a receptacle at or near a first end of the receptacle.

9. The information handling system of claim 8 wherein the first contact portion defines a first aperture disposed between the first arched flexure element and the second arched flexure element and wherein the second contact portion defines a second aperture disposed between the third arched flexure element and the fourth arched flexure element.

10. The information handling system of claim 9 wherein the first aperture and the second aperture are defined to be of a substantially identical size.

11. The information handling system of claim 9 wherein the first aperture is defined to be of a larger size and the second aperture is defined to be a smaller size.

12. The information handling system of claim 8 wherein the first contact portion and the second contact portion lie in a substantially identical plane.

13. The information handling system of claim 8 wherein the first contact portion and the second contact portion lie in different planes.

14. The information handling system of claim 8 wherein the connector pin further comprises:

a rounded tip region disposed at a first end of the first contact portion;

a junction region between the first contact portion and the second contact portion, the junction region disposed between a second end of the first contact portion and a first end of the second contact portion; and a base region disposed at second end of the second contact portion, the base region defining a transverse shoulder.

15. A method of manufacture comprising:

stamping sheet metal stock to produce a connector pin; and disposing the connector pin within a connector body, wherein the stamping comprises:

forming a first contact portion comprising a first arched flexure element and a second arched flexure element disposed in lateral opposition to the first arched flexure element; and forming a second contact portion comprising a third arched flexure element and a fourth arched flexure element disposed in lateral opposition to the third arched flexure element, the second contact portion disposed in tandem with the first contact portion, wherein the disposing the connector pin within the connector body disposes a portion of the third arched flexure element and the fourth arched flexure element within the connector body to position peaks of the third arched flexure element and the fourth arched flexure element to bear upon a receptacle at or near a first end of the receptacle.

16. The method of manufacture of claim 15 further comprising:

deburring the connector pin, wherein the deburring comprises:

deburring the first contact portion; and deburring the second contact portion.

17. The method of manufacture of claim 15 further comprising:

twisting the first contact portion relative to the second contact portion to align the first contact portion substantially in a first plane, the first plane different from a second plane in which the second contact is substantially disposed by an angular offset.

18. The method of manufacture of claim 17 wherein the twisting comprises:

twisting the first contact portion relative to the second contact portion to provide an angular offset between five and ninety degrees.

19. The method of manufacture of claim 15 wherein the forming the first contact portion comprises:

forming a first contact portion such that the first arched flexure element and a second arched flexure element provide a lower insertion force than the third arched flexure element and the fourth arched flexure element for insertion of the first arched flexure element and a second arched flexure element and of the third arched flexure element and the fourth arched flexure element within an inside diameter of a receptacle.

20. The method of manufacture of claim 15 wherein the stamping the sheet metal stock to produce the connector pin comprises:

stamping the sheet metal stock to produce the connector pin, wherein the connector pin is configured to provide, as installed, an insertion loss of less than 30 dB across a frequency range from five to thirty gigahertz.

* * * * *